US007198657B2

(12) United States Patent
Tornberg

(10) Patent No.: US 7,198,657 B2
(45) Date of Patent: Apr. 3, 2007

(54) PROCESS AND DEVICE FOR PRODUCING METAL POWDER

(75) Inventor: Claes Tornberg, Kapfenberg (AT)

(73) Assignee: Boehler Edelstahl GmbH & Co. KG, Kapfenberg (AT)

( * ) Notice: Subject to any disclaimer, the term of this patent is extended or adjusted under 35 U.S.C. 154(b) by 316 days.

(21) Appl. No.: 10/640,055

(22) Filed: Aug. 14, 2003

(65) Prior Publication Data

US 2004/0031354 A1 Feb. 19, 2004

Related U.S. Application Data

(62) Division of application No. 09/909,763, filed on Jul. 23, 2001, now Pat. No. 6,632,394, which is a division of application No. 09/484,447, filed on Jan. 18, 2000, now Pat. No. 6,334,884.

(30) Foreign Application Priority Data

Jan. 19, 1999 (AT) ..... 70/99

(51) Int. Cl.
*C22C 1/04* (2006.01)

(52) U.S. Cl. ..... 75/255; 75/338

(58) Field of Classification Search ..... 75/255, 75/338

See application file for complete search history.

(56) References Cited

U.S. PATENT DOCUMENTS 2,968,062 A 1/1961 Probst et al.
3,357,808 A 12/1967 Eberle
3,663,206 A 5/1972 Lubanska
3,752,611 A 8/1973 Reed et al.
4,032,302 A * 6/1977 Nakamura et al. ..... 75/240
4,272,463 A 6/1981 Clark et al.
4,382,903 A 5/1983 Larsson et al.
4,647,471 A 3/1987 Jenkins
4,779,802 A 10/1988 Coombs
4,905,899 A 3/1990 Coombs et al.
5,238,482 A * 8/1993 Stasko et al. ..... 75/338
5,993,509 A 11/1999 Tsao et al.
6,142,382 A * 11/2000 Ting et al. ..... 239/8
6,334,884 B1 * 1/2002 Tornberg ..... 75/337
6,506,227 B1 * 1/2003 Tornberg ..... 75/246

FOREIGN PATENT DOCUMENTS

DE 2158144 9/1972

(Continued)

OTHER PUBLICATIONS

ASM Handbook, vol. 7, Powder Metallurgy, pp. 31-35 and 95, ASM International, 1984.*

(Continued)

*Primary Examiner*—George Wyszomierski
(74) *Attorney, Agent, or Firm*—Greenblum & Bernstein, P.L.C.

(57) ABSTRACT

A metal powder produced by a process which comprises directing at least three successive gas beams at a molten metal stream inside an atomization chamber, the at least three gas beams being oriented in different directions. This abstract is neither intended to define the invention disclosed in this specification nor intended to limit the scope of the invention in any way.

20 Claims, 1 Drawing Sheet

FOREIGN PATENT DOCUMENTS

| | | |
|---|---|---|
| DE | 2222830 | 7/1975 |
| EP | 192383 | 8/1986 |
| EP | 131668 | 2/1987 |
| EP | 433264 | 6/1991 |
| FR | 1227274 | 8/1960 |
| SE | 421758 | 2/1982 |
| WO | 89/05197 | 6/1989 |

OTHER PUBLICATIONS

Claes Tornberg in "Powder Production and Spray Forming, Advances in Powder Metallurgy & Particulate Materials—1992", vol. 1, Metal Powder Industries Federation, Princeton, NJ, pp. 137-150, "Particle Size Prediction in an Atomization System".

"Lexikon der Physik", 2nd ed. 1959, Franck'sche Verlagshandlung Stuttgart, pp. 816-817.

* cited by examiner

PROCESS AND DEVICE FOR PRODUCING METAL POWDER

CROSS-REFERENCE TO RELATED APPLICATIONS

The present application is a divisional of U.S. patent application Ser. No. 09/909,763 filed Jul. 23, 2001, now U.S. Pat. No. 6,632,394 which is a divisional of U.S. patent application Ser. No. 09/484,447 filed Jan. 18, 2000, now U.S. Pat. No. 6,334,884, which claims priority under 35 U.S.C. § 119 of Austrian Patent Application No. 70/99, filed Jan. 19, 1999, the disclosures of which are expressly incorporated by reference herein in their entireties.

BACKGROUND OF THE INVENTION

1. Field of the Invention

The invention relates to a process for producing metal powder from molten metal in which a stream of molten metal leaving a nozzle element of a metallurgical vessel is broken down into droplets in an atomization chamber by gas beams and these droplets subsequently freeze (solidify) into essentially spheroidal powder grains.

The invention further relates to a device for producing metal powder from molten metal which comprises an atomization chamber into which a molten metal stream can be introduced or fed from a metallurgical vessel through a molten metal nozzle element and gas nozzle elements providing gas beams which can impinge on the molten metal stream to eventually break it down into droplets that freeze into grains, thereby yielding the metal powder.

2. Discussion of Background Information

Gas-atomized metal powders are being increasingly used in material and surface technology because of the rising quality demands on the products. The type of use determines an advantageous powder grain size and grain size distribution thereof, i.e., the respective fraction of powder grains with a specific diameter in a range of diameters. For flame spraying for surface coating of objects, for example, use of a so-called monogram powder is advantageous both from a process engineering standpoint and economically. However, in the production of parts made from metal powder using high-temperature isostatic pressing (HIP), this powder should advantageously have a high bulk density and thus have an appropriate grain size distribution.

Gas-atomized metal powders are produced essentially by causing gas, preferably inert gas or noble gas, which has a high flow speed and/or kinetic energy to impinge upon a fluid metal stream. The gas impingement causes a breakdown of the metal stream into fine droplets, which subsequently freeze to form spheroidal grains. In addition to the temperature, the viscosity and the surface tension of the fluid metal, the acceleration of the molten metal by the gas beams or the forces acting thereon are the determining factors for the size and the size distribution of the powder grains formed (Claes Tornberg in "Powder Production and Spray Forming, Advances in Powder Metallurgy & Particulate Materials—1992", Volume 1, Metal Powder Industries Federation, Princeton, N.J., pp 137–150, "Particle Size Prediction in an Atomization System", expressly incorporated by reference herein in its entirety).

If a free-falling metal stream is impinged upon in an atomization chamber by at least one gas beam, which can be an operationally reliable process, the achievable minimum powder grain size with respect to the main part of the fraction is limited since a high proportion of the gas beam energy gets lost in the zone between the gas nozzle and the metal stream. As a result thereof, the average grain diameter, as determined by sieve analysis (according to DIN 66165), of, e.g., high speed steel (HSS) powders produced by a corresponding process usually is about 130–150 μm, with the fraction of grains having a diameter above 1 mm accounting for about 2–5 wt-%. The tap density (the term "tap density" is the general expression for powder content after vibration of a container or capsule containing the powder) of such a powder usually ranges from 67 to 69% by volume. To increase the quality of the product, the desired grain size of the metal powder can be adjusted by screening out the coarse components; however, lower yield or reduced economy of production is associated therewith.

To improve the quality of the products made of or with metal powder and, in particular, to improve economy, it has long been an object to find a process which enables the production of a spheroidal metal powder with a high fine grain fraction and with a high yield.

If a breakdown of the comparatively dense stream of molten metal does not occur immediately, but if it is first flattened instead, the effect of the gas beam impinging on the fluid metal is intensified and finer droplets are formed which assume a spheroidal shape due to surface tension before freezing. The reduction in the diameter of the powder particles is, as previously stated, essentially dependent upon how fast the molten metal is accelerated.

Gas atomization processes for molten metals are known in which the fluid metal is broken down immediately after leaving the nozzle element of the metallurgical vessel by one or a plurality of gas beams from nozzles arranged directly at the nozzle outlet. Since, on the one hand, the gas has a high speed at the outlet and, on the other hand, quickly expands because of the effect of the high temperature and loses effect in the direction of the center of the beam, an extremely broad metal powder fraction with coarse and fine components is formed.

To avoid the aforementioned disadvantage, it has been proposed, according to U.S. Pat. No. 2,968,062, to use a device with an outwardly expanding molten metal nozzle and to design the gas feed channel concentrically around this nozzle in the shape of a cone. The gas beam generates a central underpressure which causes the molten metal to flow to the edge of the expanding outlet port, where this thin molten metal film is picked up by the gas beam and effectively broken down and accelerated. While very fine grained powders can be produced with such devices, their tendency to fail frequently and the low quantity of molten metal which can be processed thereby are disadvantageous. The disclosure of U.S. Pat. No. 2,968,062 is expressly incorporated by reference herein in its entirety.

To improve the functional reliability of the atomization device, U.S. Pat. No. 4,272,463 proposes allowing the stream of molten metal to leave the molten metal nozzle element in a free-fall and impinging on it with gas beams after a falling stretch. Despite the use of nozzles which form gas beams with supersonic speed, no acceleration of the molten metal adequate for the formation of powder grains with a advantageously small diameter could be obtained. The disclosure of U.S. Pat. No. 4,272,463 is expressly incorporated by reference herein in its entirety.

An attempt has already been made to use smaller distances between the nozzles to increase the accelerating effect of the gas beams directed at the free-falling metal stream. However, in the nozzle region, gas vortices are induced by the suction of the gas beam being discharged and/or because of the ejector effect, which gas vortices can entrain or return droplets if the distance between the nozzles and the breakdown site of the metal stream is too small. These entrained or returned droplets ultimately settle on the nozzle elements and have a destabilizing effect on the process (plugging of the nozzle elements). For these reasons, a minimum distance between nozzles must be provided which, on the other hand, unduly reduces the efficiency of the gas beam with regard to breaking down the molten metal into small droplets. For example, when a gas stream leaves a Laval nozzle at supersonic speed, its force at a distance of 30 times the nozzle diameter is reduced by approximately 50%.

From SE-AS-421758 a device for producing metal powder has become known in which two gas beams are used to break down the molten metal stream in the atomization chamber. The free-falling molten metal stream is impinged upon by a first gas beam at an angle of approximately 20°, which results in breakup and deflection of the stream, whereafter it is vertically broken down into metal droplets by a second gas stream of high intensity. While adhesion of metal droplets on the gas nozzle parts is avoided with this process, the large distance of the second nozzle from the breakdown point of the molten metal causes a broad grain size distribution with a small fraction of (desirable) fine powder. The disclosure of SE-AS-421758 is expressly incorporated by reference herein in its entirety.

A process for impingement on a vertical metal stream by a horizontal gas beam is proposed in U.S. Pat. No. 4,382,903, in which an advantageously smaller distance between nozzles is used. To prevent adhesion of metal droplets on the nozzle element, an auxiliary gas beam, aimed at an angle toward the breakdown site, is formed in the nozzle region. The breakdown of the compact molten metal stream occurs almost exclusively in the center of the horizontally directed primary gas beam, such that the yield of fine grained powder is low. The disclosure of U.S. Pat. No. 4,382,903 is expressly incorporated by reference herein in its entirety.

Another process for producing metal powder by impingement on a molten metal stream by horizontal gas beams is disclosed in International Patent Application WO 89/05197. According to this process, two flat gas beams with an essentially vertical narrow side are aligned at an acute angle to one another and the molten metal stream is introduced in the region of the collision of the beams such that first the surface zone and then the other partial zones of the metal stream are impinged upon by the gas beams. Because of the increased breakdown zone or due to the length of the distance over which the breakdown of the fluid metal occurs, the specific action of forces on the fluid metal is high; however, the energy of the gas beams is restricted by the limit of the speed of sound. A metal powder produced in this manner has a narrow grain diameter range; the fine and coarse particles are present only in small quantities, such that this powder tending toward a monogram has disadvantages for some applications because of its low bulk density. The disclosure of International Patent Application WO 89/05197 is expressly incorporated by reference herein in its entirety.

All commercial processes for producing metal powder economically in large batch sizes from molten metal and the devices which can be used therefor have in common the shortcoming that the fine powder fraction is too small and/or the grain size distribution is disadvantageous for economical further processing into high-quality products.

SUMMARY OF THE INVENTION

The present invention is directed to a process for producing a metal powder from molten metal with which, with a high fraction of fine grains and avoidance of undesirable coarse particles, a broad grain size distribution of the powder within the desired limits can be obtained economically.

The present invention also is directed to a device with which metal powder is reasonably producible from molten metal in a fraction or with a grain size distribution with which this powder can be further processed, possibly by high-temperature isostatic pressing (HIP), into particularly high-quality products.

The present invention relates to a process for producing a metal powder from molten metal. The process includes the provision of molten metal in a metallurgical vessel having a nozzle element, the nozzle element being directed into an atomization chamber associated with the metallurgical vessel. The molten metal is allowed to flow through the nozzle element of the metallurgical vessel into the atomization chamber whereby a molten metal stream is fed into the atomization chamber. At least three successive gas beams are directed at the molten metal stream inside the atomization chamber, the at least three gas beams being oriented in different directions. Thereby the molten metal stream is broken down into droplets. The droplets subsequently freeze into grains, whereafter they are collected.

The molten metal stream fed into the atomization chamber is advantageously a substantially vertical molten metal stream, e.g., a free-falling stream. Preferably each of the at least three gas beams is provided by a corresponding gas nozzle element. It also is preferred that the at least three successive gas beams include at least one first gas beam, at least one second or intermediate gas beam and at least one third or last gas beam, which gas beams impinge on the molten metal stream in the given order. Of these, the at least one first gas beam is directed at the molten metal stream so as to deflect the molten metal stream and to widen and thin and/or divide said molten metal stream. Preferably the molten metal stream is widened by the at least one first gas beam to at least about 5 times, even more preferred about 10 times, its original width. The at least one second gas beam is designed to have a directional component which is identical with a directional component of the at least one first gas beam and to prepare the molten metal stream widened and/or divided by the at least one first gas beam in its shape and/or to form a suction barrier for the nozzle element(s) providing the at least one third gas beam. The at least one third gas beam is a high-speed (preferably at least about 90% sonic and most preferred supersonic) gas beam designed to impinge upon the metal stream and to thereby cause a breakup of the molten metal stream into droplets.

The molten metal stream fed into the atomization chamber usually will have a width of from about 2.0 to about 10.0 mm.

The average diameter of the grains produced by the present process, as determined by sieve analysis, preferably is not more than about 80 μm. This average diameter in combination with an advantageous diameter distribution results in a metal powder of high bulk density.

Consequently, the present invention also relates to a metal powder produced by the above process.

The present invention also relates to a device for producing metal powder from molten metal, in particular one that is suitable for carrying out the above process. The device includes a metallurgical vessel for holding molten metal provided with a nozzle element for discharging molten metal from the metallurgical vessel in the form of a molten metal stream. It also includes an atomization chamber in association with the metallurgical vessel for receiving the molten metal stream discharged from the nozzle element and at least three gas nozzle elements for providing at least three gas beams of different orientation and directed at different points of the molten metal stream inside the atomization chamber. At least one of the at least three gas nozzle elements is capable of providing a gas beam which deflects and widens and/or divides the molten metal stream entering the atomization chamber; and at least one other gas nozzle element is capable of providing a gas beam which breaks down a widened and/or divided molten metal stream into droplets.

Advantageously the at least three gas nozzle elements are arranged inside the atomization chamber.

It is preferred for the at least three gas nozzle elements to comprise at least one first gas nozzle element for providing a first gas beam, at least one second or intermediate gas nozzle element for providing a second or intermediate gas beam; and at least one third or last gas nozzle element for providing a third or last gas beam.

The at least one third or last gas nozzle element generally comprises a Laval nozzle capable of providing a supersonic gas beam.

Preferably the at least three gas nozzle elements comprise gas nozzle elements with which the direction, the intensity or both of the gas beam provided thereby can be adjusted.

The advantages obtained with the invention are essentially that the fluid metal undergoes high acceleration at the time of its breakdown into droplets because, on the one hand, its mass relative to the area which is ultimately impinged upon by the last gas beam in the sequence is low and, on the other hand, the impingement occurs by means of a gas beam exerting a high force. However, it is essential to the invention that the molten metal stream is prepared before the high-energy breakdown into small droplets by at least two upstream gas beams each in a different direction such that there occurs, in a first step, an increase of the attack surface and, in a second step, a conditioning of the moving molten metal. If synergistically the mass of the molten metal relative to the attack surface is small and the force of the gas beam is high, the acceleration is high and particles with a small diameter are formed. Scientifically expressed, the following relationship exists: the particle size approaches the value of the square root of a constant divided by the acceleration.

In the invention, provision is made for the molten metal stream leaving the molten metal nozzle element of the metallurgical vessel to be deflected in its direction of flow by at least one first gas beam and to be widened and thinned and/or divided, whereupon at least one second gas beam impacting at an angle having an identical directional component prepares the widened and/or divided flat molten metal stream in its shape and forms a suction barrier for the nozzle(s) providing at least one downstream third gas beam, which third gas beam may be provided at an angle up to partially the opposite direction of the prepared flat molten metal stream as a high-speed gas beam and causes a fine division or atomization of the fluid beam into droplets. These fluid droplets subsequently freeze to form solid metal grains that constitute the desired metal powder. With a deflection and widening of the compact molten metal stream caused by the first gas beam, it is possible to produce a largely flat shape of the metal stream on the impact side, with the flow speed and the flow angle of the gas beam being determined by the thickness and the stability or the length of the free-falling molten metal stream as well as the desired thinning or widening. Opposite the impingement side, a surface form that may be unfavorable for the ultimate breakdown of the flat molten metal stream often develops, with metal particles torn off. According to the invention, this side of the flat stream with an unfavorable surface form is impacted at an angle by at least one downstream second gas beam and thereby the stream is prepared for an effective breakdown into metal droplets by at least one third or last gas beam. With this at least one second gas beam, it is also possible to set up a suction barrier, which provides the further advantage that no fluid particles can reach the at least one third or last nozzle element, such that operational reliability of the device is not compromised in this regard. With a view to a breakdown into fine metal droplets, it is furthermore important that the last (high-speed) beam is directed at an angle at the flat molten metal stream since this yields a high active force. The greater the angle relative to the flat stream which can sometimes reach almost the opposite direction from the gas beam, the higher the acceleration of the metal and ultimately the greater the fine grain fraction of the metal powder.

The metal to be employed in the subject process is not particularly limited as long as the metal is capable of existing in the form of a metal powder at ambient conditions and does not have too high a melting point which would make the melting process uneconomical. The term "metal" as used herein includes both single metals and alloys as well as blends of any two or more metals which do not form an alloy. Specific examples of metals suitable for the process of the present invention include iron, cobalt, nickel, chromium, manganese, vanadium, titanium, zirconium, copper, zinc, tin, magnesium, aluminum, lead and alloys comprising one or more of said metals. Preferred alloys for use in the process of the present invention are iron-based alloys, e.g. steel, particularly high-carbon steel compositions which contain a high concentration of carbide-forming metal. Examples thereof are high-alloy steel such as, e.g., HSS as well as cold work steel. Cold work steel compositions usually include, in wt-%, about 1–3.5, particularly about 1.5–3, C, about 5–20, particularly about 7–18, Cr, about 3–15, particularly about 4–10, V, about 1–5, particularly about 1.2–4, Mo, up to about 1.0, particularly up to about 0.7, Si, and up to about 1.0, particularly up to about 0.5, Mn, with the remainder being iron and impurities such as aluminum (usually up to about 0.05) and the like. Typical HSS steel compositions include, in wt-%, about 1–3, particularly about 1.2–2, C, about 3.5–6, particularly about 4–5, Cr, about 3–8, particularly about 4–6, Mo, about 2–10, particularly about 3–6, V, about 3–20, particularly about 5–12, W, about 0–2, particularly about 0–1, Nb, up to about 1.0, particularly about 0.7, Si, and up to about 1.0, particularly up to about 0.5, Mn, with the remainder iron and impurities. It is preferred for the metals to be employed in the process of the present invention to have a melting point or a liquids temperature, respectively which is not higher than about 1800° C., particularly not higher than about 1600° C. and most preferred not higher than 1400° C.

The gases to be used in the various gas beams to impinge upon the molten metal stream are not particularly limited as long as they do not react with the (molten) metal or, if they do, do not result in any undesired or undesirable, respectively properties of the metal powder to be produced. The term "gas" as used herein includes both single gases and gas mixtures. Particularly preferred gases for use in the present invention are inert gases, including noble gases, such as, e.g., nitrogen, argon, xenon, carbon dioxide and mixtures of two or more thereof. Moreover, if the metal to be processed in accordance with the present invention is resistant to oxidation or if some oxidation at the surface of the metal grains is even desired, it is also possible to employ oxygen or oxygen-containing gas mixtures, particularly air. It is, of course, also possible to use different gases and gas mixtures for the various gas beams. A particularly preferred example of a gas to be employed in accordance with the present invention is nitrogen. Especially if a steel composition is to be processed nitrogen is the gas of choice since it dissolves in the steel and thereby does not give rise to any problems with respect to, e.g., microporosity if the resulting steel powder subsequently is to be used for hot-temperature isostatic pressing.

The molten metal stream fed into the atomization chamber generally has a width of from about 2.0 to about 10.0 mm, preferably of from about 4.0 to about 8.0 mm and particularly preferred of from about 5.0 to about 7.0 mm. Depending on the shape of the nozzle opening through which the molten metal is discharged from the metallurgical vessel the cross-section of the molten metal stream may be essentially rectangular or circular or of any other shape. Apparently, if the cross-section is circular, the above width equals the diameter. In all other cases the width is the largest dimension of the cross-section. If the width of the molten metal stream is below about 2.0 mm, plugging problems may occur and the operation of the process may become instable. If the width of the molten metal stream exceeds about 10.0 mm, on the other hand, the average diameter of the resulting metal powder grains may become undesirably high. A width of about 6.0 mm usually affords the best results.

Regarding the temperature conditions in the atomization chamber, the temperature is not critical. This is due to the fact that the molten metal loses most of its heat (usually about 90%) by radiation so that heat loss by thermal conduction (transfer of heat to the gas inside the atomization chamber) only plays a minor role. Therefore also the temperature of the gas beams to impinge upon the molten metal stream is not particularly critical. The temperature can, for example, be between about 20° and about 100° C., with the temperature inside the atomization chamber depending on the rate at which the heat given off by the molten metal stream can be removed by, e.g., cooling the walls of the atomization chamber from the outside (for example with water). Usually the temperature inside the atomization chamber will be kept below or at around 200° C., e.g. below or around 150° C.

In the following the relationship between the various gas beams and the molten metal stream will be explained in some more detail.

Both for a high fine grain fraction in the powder and in order to avoid the formation of large particles which must be separated out, it is particularly advantageous for the molten metal stream to be deflected in its flow direction, by the at least one first gas beam, by an angle between about 5° and about 85°, preferably between about 10° and about 45°, and particularly preferred between about 15° and about 30°. The at least one first gas beam also serves to widen and thin and/or divide the molten metal stream entering the atomization chamber. The widened and thinned (flattened) stream preferably assumes essentially the shape of a sector of a circle. A deflection of the molten metal stream by less than about 5° is unfavorable, since this requires a sudden increase in the formation length of the widened stream, which increase is, however, limited by the temperature loss. A particularly efficient formation of a flat stream of the fluid metal is obtained with a deflection thereof at an angle between about 15° and about 30°, particularly around 20°. Deflections greater than about 45° may in some cases cause a disadvantageous disintegration of the stream by the at least one first gas beam. In order to obtain particularly good results, the at least one first gas beam should widen the molten metal stream by a factor of at least about 5, preferably at least about 10. This means that the largest width of the molten metal stream after the at least one first gas beam has impinged thereon should be at least about five times the largest width of the original molten metal stream. If the molten metal stream is widened to less than about five times the original molten metal stream width (thickness), its compactness is high and the fine powder fraction that can ultimately be produced may be relatively small.

With a view to a high fine grain fraction of metal powder and, also, a favorable grain size distribution, it is highly advantageous if the molten metal stream flattened and deflected by the at least one first gas beam, is deflected by at least one third (high-speed) gas beam by an angle between about 25° and about 150°, preferably between about 60° and about 90°, and is thereby atomized or broken down into a stream of droplets. An angle between about 60° and about 90° affords particularly good conditions for a breakdown into droplets with a high fines content, in particular if the width of the original molten metal stream has been increased by the at least one first gas beam by a factor of at least about 10. Larger deflection angles of up to about 150° increase the fine grain component but result in a tendency toward monogram formation which is disadvantageous if a high bulk density of the metal powder is desired.

In order to prepare the metal stream impinged upon by the at least one first gas beam, but in particular also in order to form an effective suction barrier, the molten metal flat stream is impinged upon, upstream from or in the zone of the deflection or atomization by the at least one third (high-speed) gas beam, by at least one second gas beam with an identical directional component. Impingement by the at least one second gas beam usually takes place at an angle ranging from about 5° to about 85°, preferably from about 10° to about 60°, and most preferably from about 15° to about 30°, relative to the molten metal stream, thereby preventing suction vortices carrying molten metal droplets caused by the at least one third (high-speed) gas beam. At beam angles of less than about 5°, suction vortices of the high-speed gas beam are not completely preventable, resulting in the danger of metal deposits on the nozzle element and instability of the process. Impingement angles of the at least one second gas beam larger than about 85° may disadvantageously distort the metal stream before its atomization and reduce the relative speed between the molten metal stream and the at least one third gas beam and, consequently, the acceleration of the metal.

Regarding the nozzle elements used to provide the at least one first gas beam, the at least one second gas beam, the at least one third gas beam and the molten metal stream discharged from the metallurgical vessel, any nozzle elements used heretofore for corresponding purposes can be used. The same applies to the metallurgical vessel and the atomization chamber used in the present invention. With respect to specific examples thereof reference may be made to the various U.S. patents mentioned above in the discussion of the background of the invention.

The nozzle elements used to provide the various gas beams may be identical or different. According to the present invention it is preferred, however, that the nozzle element providing the at least one third (high-speed) gas beam is a Laval nozzle. Regarding the design of a Laval nozzle which is well-known to the person skilled in the art, reference may be made to, e.g., "Lexikon der Physik", 2nd ed. 1959, Franck'sche Verlagshandlung Stuttgart, pp. 816–817. A Laval nozzle is preferred since it can provide a supersonic gas beam which in turn is preferred as the at least one third gas beam to impinge on the molten metal stream. It is, of course, possible to use a Laval nozzle also as nozzle element providing the at least one first and/or the at least one second gas beam.

The present invention also provides a device for producing metal powder from molten metal as set forth above.

The advantages of the invention obtainable with said device include that by means of an arrangement of at least three gas nozzle elements, the molten metal stream can be impinged upon in three zones by gas beams and can be shaped and processed thereby, with the angle of the gas beams relative to the molten metal stream advantageously ranging from about 5° to about 170° in each case.

In a preferred embodiment of the invention, at least one first gas nozzle element is arranged such that the at least one first gas beam formed thereby, having an identical directional component, is directed at the molten metal stream at an angle between about 5° and about 85°, preferably at an angle between about 15° and about 30°, and that the length of the preferably free-falling molten metal stream before it is impinged upon by the at least one first gas beam equals the distance between the opening of the at least one first gas nozzle and the point of impact of the at least one first gas beam on the molten metal stream, increased or reduced by a value which is at most about 10 times the diameter of the molten metal stream. The angle formed between the at least one first gas beam and the molten metal stream fed into the atomization chamber has an influence on the thinning and sector-shaped widening thereof, whereas the length of the undisturbed molten metal stream affects its stability during deflection and reshaping into a flat stream as well as the shape achievable thereby.

In order to create particularly preferable atomization conditions for the fluid metal, it is preferred for the at least one second nozzle element to be arranged such that the at least one second gas beam in the sequence is directed at the flat molten metal stream thinned and widened upstream by the at least one first gas beam with an identical flow direction component at an angle between about 5° and about 85°, preferably at an angle between about 15° and about 30°, and that the point of impact of the at least one second gas beam lies in the zone of or upstream from the deflection, impact, or atomization point of the at least one third gas beam located downstream. The angle between the at least one second gas beam and the flat molten metal stream and the corresponding point of impact are of twofold significance. On the one hand, the condition of the flat stream subjected to a breakdown immediately thereafter is advantageously adjustable; on the other hand, formation of suction vortices by an ejector effect of the at least one third high-speed gas beam can effectively be prevented. The selection of the angular ranges according to the invention, in particular in the preferred ranges, meets these requirements.

According to a particularly advantageous embodiment, if the at least one third nozzle element is arranged such that the at least one third or last gas beam in the working sequence is directed at the flat molten metal stream at an angle between about 25° and about 150°, preferably greater than about 60°, and that the distance between the at least one third or last gas nozzle element and the deflection, impact, or atomization point is less than about 20 times the value of the width (diameter) of said gas nozzle element, high efficiency of the device with excellent powder quality is achieved, since a high force or acceleration can be used for a breakdown of the metal into droplets. The force or acceleration increases with an increasing angle, allowing overall finer powder fractions to be produced.

It has proved advantageous for at least the third or last nozzle element in the working sequence to be designed to generate at least one supersonic gas beam.

In an improvement of the invention, advantageous breakdown conditions for the flat molten metal stream can be generated if more than two, for example three, four, five or six, gas nozzle elements for providing gas beams which can be directed at the molten metal stream are arranged upstream from the at least one last gas nozzle element which provides a high-speed gas beam.

Advantageously, good adjustment capabilities for a desired metal powder fraction result if one or more, for example all, of the gas beams are adjustable in their direction and their intensity.

According to another advantageous embodiment, if at least one gas beam is designed as a flat beam or multiple beam by the arrangement of a plurality of nozzle elements positioned next to each other and/or especially lying above each other, the available gas beam width for impingement on the molten metal stream can be increased.

Ultimately, it can also be advantageous for the plane determined by the gas beams to deviate from the vertical.

By employing the process and/or the device of the present invention it is possible to produce metal powders having an average grain diameter, as determined by sieve analysis, of not more than about 80 μm, particularly not more than about 60 μm, the fraction of grains having a diameter of more than about 500 μm being in the range of about 2–5 wt-%. This compares very favorably to the average grain diameters obtainable by the prior art as indicated above. Moreover the grain size distribution obtainable by the present invention advantageously results in a high bulk tap density of the metal powder produced.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
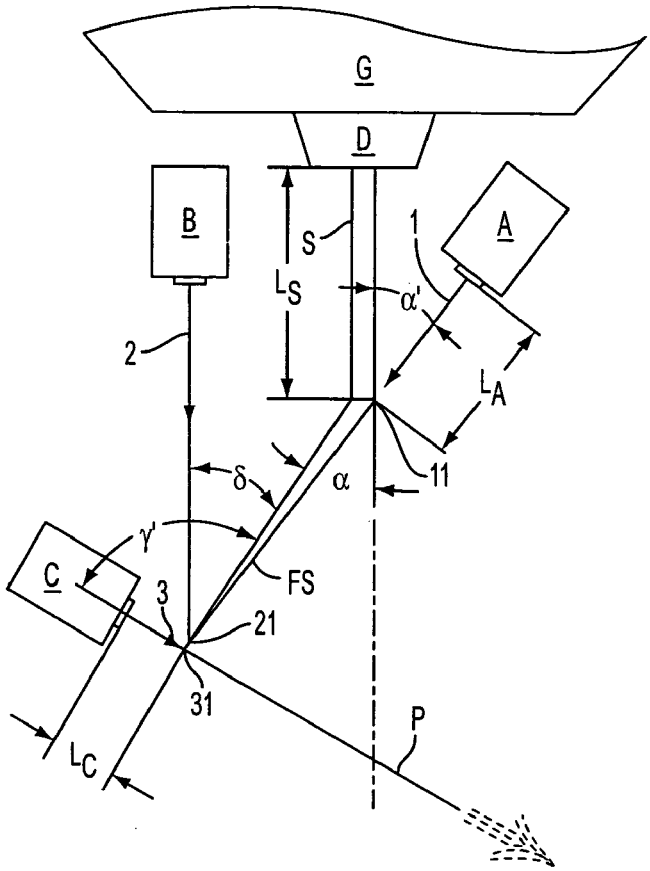
FIG. 1 shows a schematic view of a disintegration unit.

FIG. 1 schematically depicts an atomization chamber with three nozzles. Metal from a metallurgical vessel G is fed by means of a molten metal nozzle element D forming a molten metal stream S, which is formed free-falling and essentially perpendicularly over a distance $L_S$. In a typical commercial operation (production of about 1000–3000 kg metal powder/h) $L_S$ is in the range of from about 30 to about 150 mm, particularly about 50 to about 100 mm. A first gas beam 1, which impinges with an identical directional component, but at an angle α' on the molten metal stream S in the zone 11 at the distance $L_A$ is formed by a first gas nozzle A. A typical range for $L_A$ is about 30 to about 250 mm, particularly about 50 to about 100 mm. Beginning in the zone of the point of impact 11, this impingement with a first gas beam 1 causes a deflection or a change in flow direction of the compact molten metal stream S by an angle α (substantially identical with angle α') and its thinning and widening with the formation of a flat molten metal stream FS.

A second gas beam 2, which impinges on the molten metal stream FS after a broadening stretch thereof at an impact point 21 with an identical directional component, but at an angle δ, is provided by means of nozzle B. The angle δ usually ranges from about 5° to about 85°, preferably about 150 to about 30°.

A gas nozzle C, preferably a Laval nozzle, provides a gas beam 3, which impinges upon the flat molten metal stream FS at a distance $L_C$ from the nozzle C at a deflection, impact, or atomization point 31 at an angle γ and then causes its breakdown into a metal particle stream P. The impingement on the flat molten metal stream FS by the gas beam 3 can be at an angle and up to partially in the opposing direction. Particularly, the angle γ' formed between the direction of the molten metal stream deflected by gas beam 1 and gas beam 3 may range from about 25° to about 150°. The distance $L_C$ typically ranges from about 5 to about 30 mm, particularly from about 10 to about 20 mm. The cross-section of the opening of Laval nozzle C may be slot-shaped, e.g. with dimensions of about 6 mm by about 100 mm.

Also, more than three differently oriented gas beams and/or a plurality of gas beams each in a predetermined direction can be provided according to the invention.

Figure 2A:
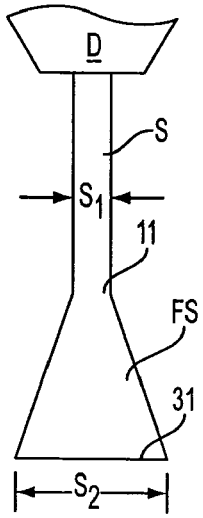
FIG. 2*a* shows a schematic view in a front elevation of a path of a molten metal stream during impingement thereon by gas beams.
Figure 2B:
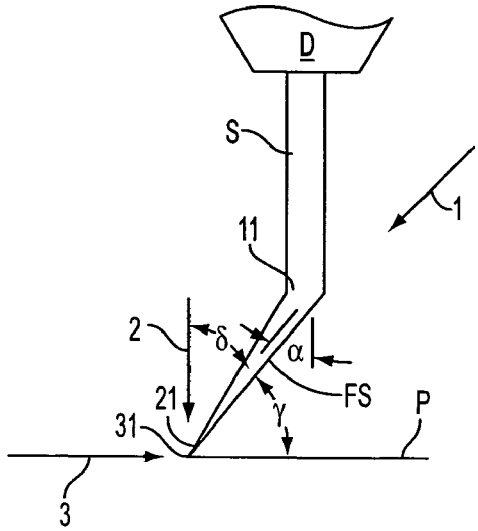
FIG. 2*b* shows a view of the path of the molten metal stream from FIG. 2*a* rotated by 90°.

FIGS. 2*a* and 2*b* depict schematically a molten metal stream S each in a view from two directions offset by 90° (front and side elevation). A molten metal stream S is fed essentially vertically from a molten metal nozzle element D into a disintegration unit of an atomization chamber. The molten metal stream S with a width (diameter) $S_1$ is impinged upon after a free-fall distance at an impact point 11 by the gas beam 1 and, thus, as is discernible from FIG. 2*b*, is diverted at an angle α and thinned and also widened, as depicted in FIG. 2*a*. After reaching a width $S_2$, the flat molten metal stream FS is impinged upon by a high-powered gas beam 3 at a deflection, impact, or atomization point 31, which beam causes the formation of a metal particle stream P. In the zone of the atomization point 31 or upstream therefrom, the flat molten metal stream FS is impinged upon and shaped by a gas beam 2, which impacts the flat stream FS at a point 21, by means of which a change in the direction of flow of the metal stream can also be effected.

It also is possible according to the present invention for a molten metal stream to be impinged upon in sequence by at least three gas beams having an identical directional component.

The following example serves to illustrate the efficiency and reliability of the invention.

A high speed steel with the following composition in % by weight was atomized in accordance with the present invention:

| | |
|---|---|
| C | 1.31 |
| Si | 0.6 |
| Mn | 0.24 |
| Cr | 4.1 |
| Mo | 4.9 |
| W | 6.0 |
| V | 2.9 |
| Fe | balance |

Other elements were present in only trace amounts.

The width of the molten metal stream from the tundish was 6 mm. The melt was atomized for 4 hours and 10 minutes and stable metal and gas flow conditions were prevailing during the whole atomization time.

The resulting powder had the following particle size distribution between 0 and 500 μm:

| Fraction in μm | % of powder in fraction |
|---|---|
| 0–45 | 34.9 |
| 46–53 | 11.3 |
| 54–63 | 12.0 |
| 64–75 | 7.4 |
| 76–100 | 8.5 |
| 101–180 | 13.0 |
| 181–250 | 5.2 |
| 251–500 | 7.7 |

The rejected powder above 500 μm was 2.7% of the total atomized weight.

The mean particle size was 57 μm.

The tap density of the powder in the capsule before HIP was 73% by volume.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A metal powder produced by a process which comprises:

providing molten metal in a metallurgical vessel having a nozzle element, the nozzle element being directed into an atomization chamber associated with the metallurgical vessel;

allowing the molten metal to flow through the nozzle element of the metallurgical vessel into the atomization chamber whereby a molten metal stream is fed into the atomization chamber;

directing at least three successive gas beams at the molten metal stream inside the atomization chamber wherein the at least three gas beams are oriented in different directions;

whereby the molten metal stream is broken down into droplets, the droplets subsequently freezing into grains;

and collecting the grains;

an average diameter of the collected grains in the as-produced state, as determined by sieve analysis, being not higher than about 80 μm, and wherein the metal comprises, in wt-%, about 1–3.5 C, about 5–20 Cr, about 3–15 V, about 1–5 Mo, up to about 1.0 Si, and up to about 1.0 Mn, remainder comprising iron and impurities.

2. The metal powder of claim 1, wherein the metal comprises at least one of cobalt, nickel, titanium, zirconium, copper, zinc, tin, magnesium, aluminum, lead.

3. The metal powder of claim 1, wherein the metal comprises an alloy.

4. The metal powder of claim 1, wherein at least one of the elements is present in the following wt-%: about 1.5–3 C, about 7–18 Cr, about 4–10 V, about 1.2–4 Mo, up to about 0.7 Si, and up to about 0.5 Mn.

5. The metal powder of claim 1, wherein the metal has at least one of a melting point and a liquidus temperature of not higher than about 1800° C.

6. The metal powder of claim 5, wherein the metal has at least one of a melting point and a liquidus temperature of not higher than about 1600° C.

7. The metal powder of claim 5, wherein the metal has at least one of a melting point and a liquidus temperature of not higher than about 1400° C.

8. The metal powder of claim 5, wherein the molten metal stream fed into the atomization chamber has a width of from about 2.0 to about 10.0 mm.

9. The metal powder of claim 8, wherein the molten metal stream fed into the atomization chamber has a width of from about 4.0 to about 8.0 mm.

10. The metal powder of claim 1, wherein at least a last gas beam of the at least three successive gas beams is a supersonic gas beam.

11. The metal powder of claim 1, wherein the gas of at least one gas beam of the at least three successive gas beams comprises nitrogen, argon or both.

12. The metal powder of claim 1, wherein the average diameter of the collected grains in the as-produced state is not higher than about 60 μm.

13. The metal powder of claim 1, wherein a fraction of grains having a diameter of more than about 500 μm is not higher than about 5% by weight.

14. A metal powder produced by a process which comprises:

providing molten metal in a metallurgical vessel having a nozzle element, the nozzle element being directed into an atomization chamber associated with the metallurgical vessel;

allowing the molten metal to flow through the nozzle element of the metallurgical vessel into the atomization chamber whereby a molten metal stream is fed into the atomization chamber;

directing at least three successive gas beams at the molten metal stream inside the atomization chamber wherein the at least three gas beams are oriented in different directions;

whereby the molten metal stream is broken down into droplets, the droplets subsequently freezing into grains; and collecting the grains;

wherein the metal comprises at least one of iron, cobalt, nickel, chromium, manganese, vanadium, titanium, zirconium, copper, zinc, tin, magnesium, aluminum, lead and has at least one of a melting point and a liquidus temperature of not higher than about 1400° C., an average diameter of the collected grains in the as-produced state, as determined by sieve analysis, being not higher than about 60 μm and a fraction of grains having a diameter of more than about 500 μm being from about 2% to about 5% by weight.

15. The metal powder of claim 14, wherein the metal comprises, in wt-%, about 1–3.5 C, about 5–20 Cr, about 3–15 V, about 1–5 Mo, up to about 1.0 Si, and up to about 1.0 Mn, the remainder comprising iron and impurities.

16. The metal powder of claim 14, wherein the metal comprises, in wt-%, about 1–3 C, about 3.5–6 Cr, about 3–8 Mo, about 2–10 V, about 3–20 W, about 0Nb, up to about 1.0 Si, and up to about 1.0 Mn, the remainder comprising iron and impurities.

17. The metal powder of claim 16, wherein at least one of the elements is present in the following wt-%: about 1.2–2 C, about 4–5 Cr, about 4–6 Mo, about 3–6 V, about 5–12 W, about 0–1 Nb, up to about 0.7 Si, and up to about 0.5 Mn.

18. A metal powder produced by a process which comprises:

providing molten metal in a metallurgical vessel having a nozzle element, the nozzle element being directed into an atomization chamber associated with the metallurgical vessel;

allowing the molten metal to flow through the nozzle element of the metallurgical vessel into the atomization chamber whereby a molten metal stream is fed into the atomization chamber;

directing at least three successive gas beams at the molten metal stream inside the atomization chamber wherein the at least three gas beams are oriented in different directions;

whereby the molten metal stream is broken down into droplets, the droplets subsequently freezing into grains;

and collecting the grains; wherein the average diameter of the collected grains in the as-produced state, as determined by sieve analysis, is not higher than about 80 μm and a fraction of grains having a diameter of more than about 500 μm is from about 2% to about 5% by weight and wherein the metal comprises, in wt-%, either (i) about 1–3.5 C, about 5–20 Cr, about 3–15 V, about 1–5 Mo, up to about 1.0 Si, and up to about 1.0 Mn, the remainder comprising iron and impurities, or (ii) about 3.5–6 Cr, about 3–8 Mo, about 2–10 V, about 3–20 W, about 0–2 Nb, up to about 1.0 Si, and up to about 1.0 Mn, the remainder comprising iron and impurities.

19. The metal powder of claim 18, wherein the metal comprises, in wt-%, about 1–3 C, about 3.5–6 Cr, about 3–8 Mo, about 2–10 V, about 3–20W, about 0–2 Nb, up to about 1.0 Si, and up to about 1.0 Mn, the remainder comprising iron and impurities.

20. The metal powder of claim 19, wherein at least one of the elements is present in the following wt-%: about 1.2–2 C, about 4–5 Cr, about 4–6 Mo, about 3–6 V, about 5–12 W, about 0–1 Nb, up to about 0.7 Si, and up to about 0.5 Mn.

* * * * *